US010190850B2

(12) United States Patent
Prater

(10) Patent No.: US 10,190,850 B2
(45) Date of Patent: Jan. 29, 2019

(54) SNIPER DASHBOARD

(71) Applicant: Chadwick Hampton Prater, Whispering Pines, NC (US)

(72) Inventor: Chadwick Hampton Prater, Whispering Pines, NC (US)

( * ) Notice: Subject to any disclaimer, the term of this patent is extended or adjusted under 35 U.S.C. 154(b) by 0 days.

(21) Appl. No.: 15/175,446

(22) Filed: Jun. 7, 2016

(65) Prior Publication Data

US 2017/0350675 A1 Dec. 7, 2017

(51) Int. Cl.
*F41A 35/00* (2006.01)
*F41G 3/08* (2006.01)

(52) U.S. Cl.
CPC ..... *F41G 3/08* (2013.01); *F41A 35/00* (2013.01)

(58) Field of Classification Search
CPC ..... F41A 35/00; F41G 3/08
USPC ..... 42/90
See application file for complete search history.

(56) References Cited

U.S. PATENT DOCUMENTS 7,255,035 B2 * 8/2007 Mowers ..... F41G 1/467 42/131
7,614,174 B1 * 11/2009 Beltz ..... F41A 23/10 42/72
8,091,265 B1 * 1/2012 Teetzel ..... F41C 23/16 42/124
8,281,995 B2 * 10/2012 Bay ..... F41G 3/06 235/414
8,297,173 B1 * 10/2012 Teetzel ..... F41G 3/165 42/111
8,578,647 B2 * 11/2013 Storch ..... F41C 27/00 248/187.1
8,806,797 B1 * 8/2014 Petersen ..... F41G 11/004 42/90
8,971,959 B2 * 3/2015 Hunt ..... F41G 11/004 455/556.1
8,978,539 B2 * 3/2015 Teetzel ..... F41A 23/08 42/111
2009/0313873 A1 * 12/2009 Roth ..... F41C 23/16 42/72
2011/0076095 A1 * 3/2011 Storch ..... F41C 27/00 403/322.4
2011/0168777 A1 * 7/2011 Bay ..... F41G 3/06 235/414
2013/0002049 A1 * 1/2013 Stampfli ..... H01M 2/1022 307/150
2013/0279065 A1 * 10/2013 Froom ..... F41H 13/0025 361/232
2013/0288743 A1 * 10/2013 Hunt ..... F41G 11/004 455/556.1
2014/0110482 A1 * 4/2014 Bay ..... F41G 1/38 235/404
2015/0041538 A1 * 2/2015 Teetzel ..... F41A 23/08 235/404

* cited by examiner

*Primary Examiner* — Jonathan C Weber
(74) *Attorney, Agent, or Firm* — Workman Nydegger

(57) ABSTRACT

A sniper dashboard for displaying ballistics data attaches to a rail interface system (RIS) of a rifle or other longarm. The dashboard comprises a support arm, a mounting block that is rotatably attached to the support arm, and a display panel to support a ballistic data card or calculator. The support arm includes a clamping mechanism for removably mounting the support arm to the firearm such that the display panel is positioned within the shooter's field of view while the shooter is taking aim at a target.

6 Claims, 2 Drawing Sheets

SNIPER DASHBOARD

FIELD OF THE INVENTION

The present invention relates generally to firearm accessories and, more particularly, to a sniper dashboard that attaches to a firearm for displaying ballistics information to a user while in a shooting position.

BACKGROUND

Experienced marksmen need to account for bullet drop and windage over different temperature ranges and altitudes when aiming at a target. Precision long range shooters, such as military or police marksmen, often rely on pre-computed ballistic data cards to get the correct compensation factors to compensate for bullet drop and windage. In the field, the ballistic data cards may be attached to an arm band that is worn on the shooter's arm. A problem with this approach is that the ballistic data card attached to an arm band is usually not visible to the shooter while looking through a scope and taking aim at a target. If the shooter refocuses even momentarily on a ballistic data card that is attached to an arm band, the target may no longer be in sight when the shooter's attention is turned back to the target.

Accordingly, there is a need for a device that is capable of displaying ballistic data to a shooter that is within the field of view of the shooter while the shooter is taking aim at a target.

SUMMARY

The present disclosure relates generally to a sniper dashboard that attaches to a rail interface system (RIS) of a rifle or other longarm. The dashboard comprises a support arm, a mounting block that is rotatably attached to the support arm, and a display panel to support a ballistic data card or calculator. The support arm includes a clamping mechanism for removably mounting the support arm to the firearm such that the display panel is positioned within the shooter's field of view while the shooter is taking aim at a target. In one exemplary embodiment, the ballistics data card or calculator may be attached to the display panel by a hook and loop fastener (e.g., VELCRO® fastener), although other fastening mechanisms may be employed. In one embodiment, the display panel and mounting block are movable between a "use" position in which the display panel extends generally perpendicularly from one side of the rifle, and a "storage" position in which the display panel is folded against the rifle.

DETAILED DESCRIPTION

Figure 1:
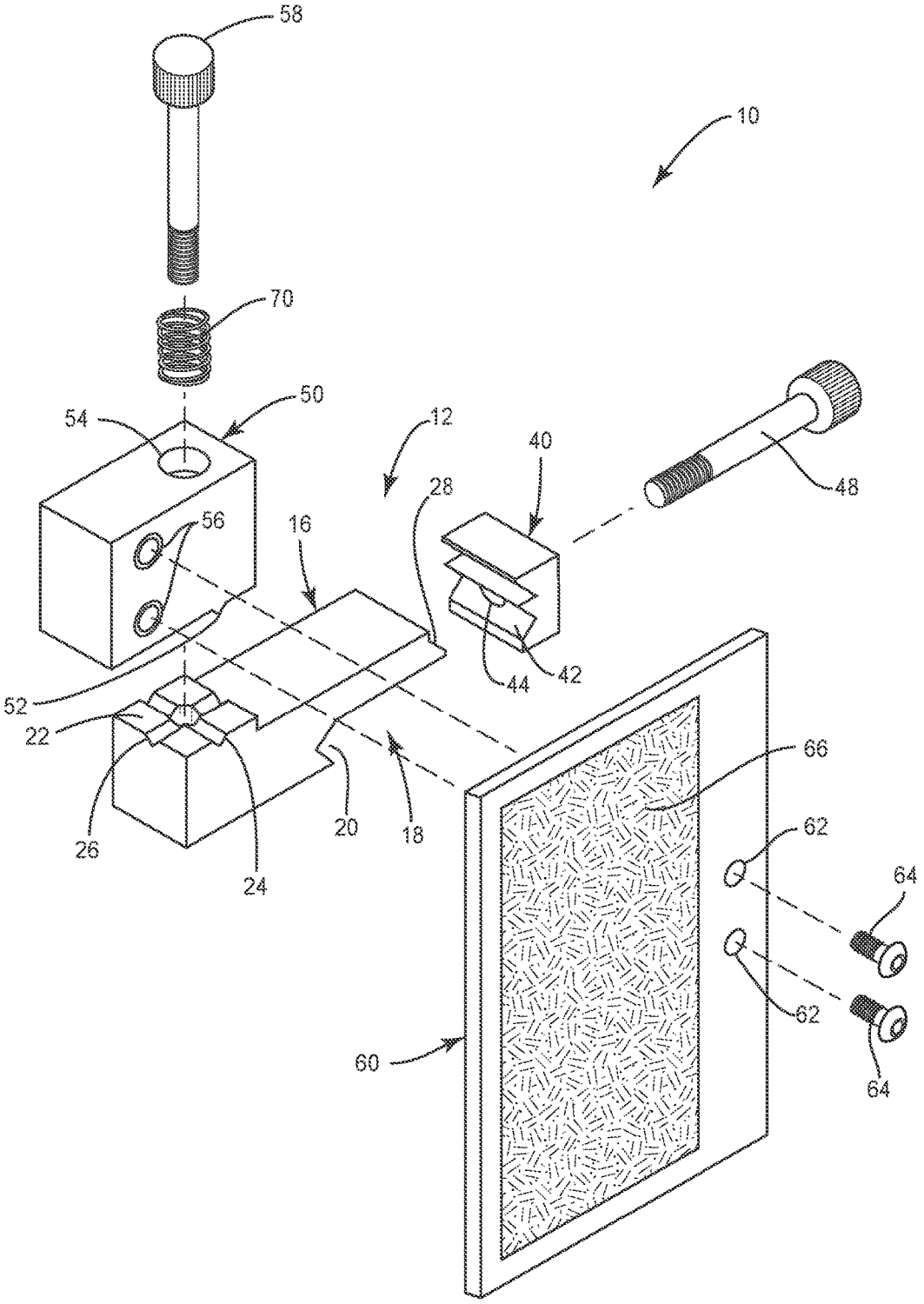
FIG. 1 is a perspective view of the sniper dashboard according to one exemplary embodiment.

Referring now to the drawings, an exemplary embodiment of a sniper dashboard indicated generally by the numeral 10 is shown therein. The sniper dashboard 10 removably mounts to a rifle or other longarm and is designed to present a ballistics data card or calculator to a shooter while the shooter is taking aim at a target. The sniper dashboard 10 presents the ballistics data card or calculator in the shooter's field of view while the shooter is taking aim, i.e., looking through the scope.

The main functional components of the sniper dashboard 10 comprise a support arm 12, a mounting block 50, and a display panel 60. The support arm 12 includes a clamping member 40 for attaching the support arm 12 to a RIS on the rifle. The mounting block 50 rotatably mounts to the support arm 12 and supports the display panel 60 so as to be movable between a "use" position and a "storage" position. The support arm 12, mounting block 50, and display panel 60 are preferably made from a hardened, powder-coated or anodized steel that is durable and resistant to corrosion.

Figure 2:
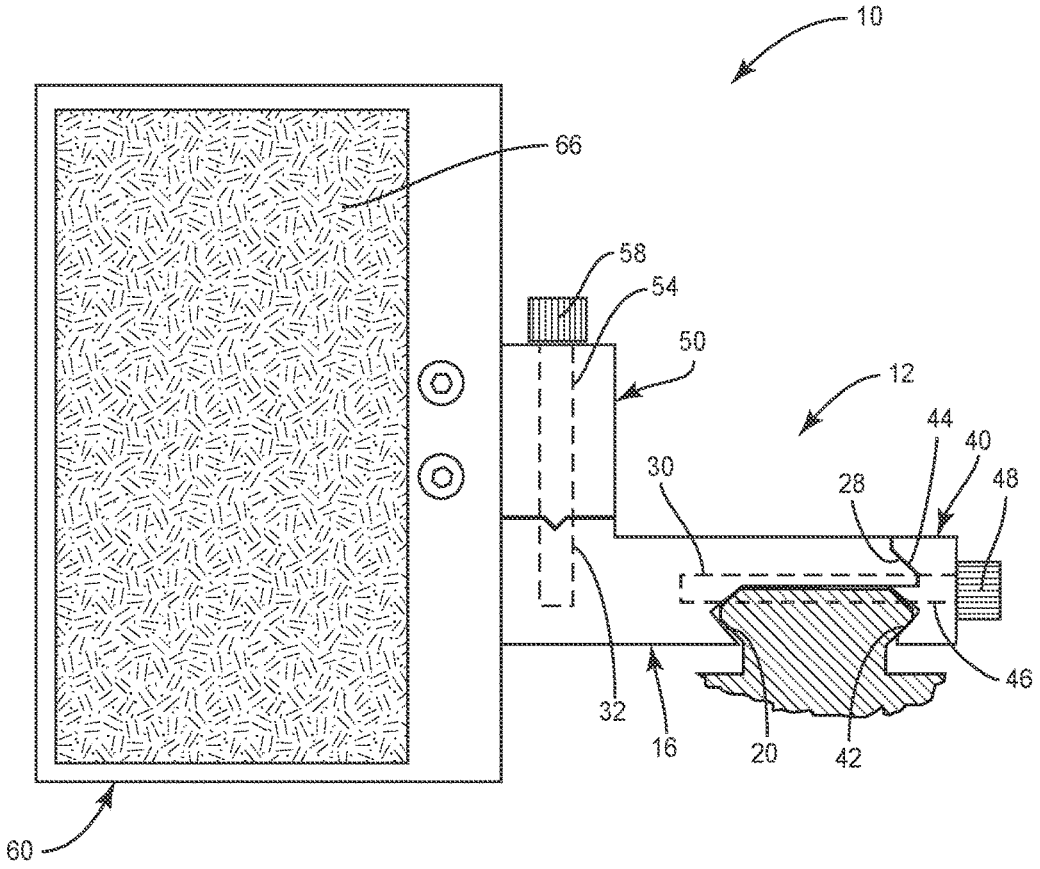
FIG. 2 is an elevation view of the sniper dashboard attached to a Picatinny rail interface system.

The support arm 12 comprises a main support member 16 and a clamping member 40 attached to a proximate end of the main support member 16. The bottom surface of the main support member 16 includes a cut out that extends from the proximate end of the main support member 16 and terminates at a v-shaped groove 20. The clamping member 40 has a similarly shaped v-shaped groove 42. The v-shaped grooves 20, 42 are designed to engage RIS on the rifle. In the exemplary embodiment, the v-shaped grooves 20, 42 are designed to engage the rail of a Picatinny RIS, which is shown in FIG. 2. Those skilled in the art will appreciate that the support arm 12 could be designed to engage with other types of RISs.

The top surface of the main support member 16 includes a raised mounting surface 22 to which the mounting block 50 attaches. The raised mounting surface 22 provides a surface for mounting the mounting block 50 as hereinafter described. The raised mounting surface 22 includes two v-shaped grooves 24 and 26 disposed at 90° angles. The orientations of the v-shaped grooves 24 and 26 define two preset positions for the display panel 60: the "use" position and the "storage" position.

The proximate end of the main support member 16 includes a cam surface 28 that engages with a cam surface 44 on the clamping member 40. The cam surfaces 28 and 44 allow some slight vertical movement of the clamping member 40 when the clamping member 40 is tightened or loosened. The slight vertical movement facilitates mounting of the support arm 12 to the RIS.

The clamping member 40 is secured to the main support member 16 by a clamping screw 48 that extends through an unthreaded bore 46 in the clamping member 40 and threadably engages with a first threaded hole 30 in the main support member 16. When the clamping screw 48 is tightened, the clamping member 40 is pulled inwardly to firmly engage the RIS. As previously noted, the cam surfaces 28 and 44 will cause the clamping member 40 to move slightly upward when the clamping screw 48 is tightened. Loosening the clamping screw 48 allows the clamping member 40 to disengage from the RIS.

The mounting block 50 comprises a generally rectangular block having a v-shaped protrusion 52 on a bottom surface of the mounting block 50. The v-shaped protrusion 52 is configured to engage the v-shaped grooves 24, 26 on the raised mounting surface 22 of the support arm 12. The mounting block 50 is secured to the main support member 16 by a mounting screw 58. The mounting screw 58 extends through a unthreaded bore 54 in the mounting block 50 and threadably engages a second threaded hole 32 in the main support member 16. A compression spring 70 may be disposed between the head of the mounting screw 58 and the top surface of the mounting block 50. The compression spring 70 pushes against the top surface of the mounting block 50 to keep the v-shaped protrusion 52 on the mounting block 50 engaged with one of the v-shaped grooves 24, 26 on the raised mounting surface 22. When a rotating force is applied to the mounting block 50, the spring 70 will yield to allow rotation of the mounting block 50 between the "use" position and the "storage" position. The amount of force applied to the mounting block 50 by the compression spring 70 may be adjusted by tightening or loosening the mounting screw 58.

The display panel 60 comprises a generally flat planar member that is detachably secured to the mounting block 50. This display panel 60 includes a pair of unthreaded bores 62 that align with threaded openings 56 in the mounting block 50. The display panel 60 can be secured to either side of the mounting block 50 by mounting screws 64 that pass through the unthreaded holes 62 in the display panel 60 and threadably engage the threaded openings 56 in the mounting block 50. Switching the display panel 60 from one side of the mounting block 50 to the other enables the sniper dashboard 10 to be used with the display panel 60 on either the left side or the right side of the rifle barrel.

In the disclosed embodiment, the mounting block 50 and display panel 60 are separate components. In other embodiments, the mounting block 50 and display panel 60 could be manufactured as a unitary component.

The display panel 60 is designed to support a ballistics data card or calculator, which may be attached to the display panel 60 by means of a hook and loop type fastener. A first part of the hook and loop fastener 66 may cover the surface of the display panel 60. The second part of the hook and loop fastener (not shown) may be secured to the data card or calculator. The data card or calculator can then be quickly attached to the display panel by pressing the first and second parts of the hook and loop fasteners together. Those skilled in the art will appreciate that other forms of attachment may be used in place of the hook and loop fasteners. For example, the data card or calculator could be held in place by an elastic band that extends around the display panel 60. In another embodiment, the data card may be inserted into a sleeve with a transparent cover panel that slides down over the display panel 60.

In use, the sniper dashboard 10 is positioned at a desired position along the RIS and the clamping screw 38 is tightened so that the v-shaped grooves 20, 42 firmly engage the RIS. A ballistics data card or calculator may then be attached to the display panel 60. The display panel 60 may be moved between a "use" position and a "storage" position. In the "use" position, the the v-shaped protrusion 52 on the mounting block 50 engages with the v-shaped groove 24 in the raised mounting surface 22 and the display panel 60 is positioned to extend perpendicularly from one side of the rifle barrel. In the "storage" position, the v-shaped protrusion 52 on the mounting block 50 engages with the v-shaped groove 26 in the raised mounting surface 22 and the display panel 60 is folded back against the rifle barrel. Thus, the v-shaped protrusion 52, in combination with the v-shaped grooves 24, 26 on the raised mounting surface 22, function as an indexing mechanism to define the different positions of the display panel.

What is claimed is:

1. A sniper dashboard comprising:

a support arm including a clamping member configured to be removably mounted to a rail interface system of a firearm, the support arm comprising a raised mounting surface having two v-shaped grooves formed thereon, the two v-shaped grooves being disposed orthogonally, and a threaded bore defined at an intersection of the two v-shaped grooves;

a mounting block comprising a v-shaped protrusion shaped to selectively fit within either of the two v-shaped grooves and an unthreaded bore defined by the mounting block such that the unthreaded bore aligns with the threaded bore of the support arm when the v-shaped protrusion fits within either of the two v-shaped grooves;

a mounting screw configured to threadedly engage the threaded bore;

a compression spring disposed about a shaft of the mounting screw and between a head of the mounting screw and the mounting block;

a display panel rotatably mounted to the support arm; and an attachment mechanism for removably attaching a ballistics data card or calculator to the display panel, wherein the compression spring maintains engagement of the v-shaped protrusion with one of the two v-shaped grooves and upon a rotating force being applied to the mounting block, the compression spring yields to allow rotation of the v-shaped protrusion between the other of the two v-shaped grooves.

2. The sniper dashboard of claim 1 wherein said display panel is secured to the mounting block.

3. The sniper dashboard of claim 2 wherein the display panel removably attaches to the mounting block.

4. The sniper dashboard of claim 1 wherein the support arm includes a main support member having a first v-shaped groove, and wherein the clamping member includes a second v-shaped groove, said first and second v-shaped grooves configured being configured to engage the rail interface system of the firearm.

5. The sniper dashboard of claim 4 wherein the main support member includes a first cam surface that engages with a second cam surface on the clamping member so that the clamping member moves vertically relative to the main support member when the clamping member is being clamped to the rail interface system.

6. The sniper dashboard of claim 1, wherein the attachment mechanism comprises a hook and loop fastener.

* * * * *